US011992055B2

(12) United States Patent
Niu et al.

(10) Patent No.: US 11,992,055 B2
(45) Date of Patent: May 28, 2024

(54) ATOMIZER

(71) Applicant: SHENZHEN JIANAN TECHNOLOGY CO., LIMITED, Guangdong (CN)

(72) Inventors: Jianhua Niu, Guangdong (CN); Jianjun Ding, Guangdong (CN)

(73) Assignee: SHENZHEN JIANAN TECHNOLOGY CO., LIMITED, Shenzhen (CN)

( * ) Notice: Subject to any disclaimer, the term of this patent is extended or adjusted under 35 U.S.C. 154(b) by 112 days.

(21) Appl. No.: 17/574,544

(22) Filed: Jan. 12, 2022

(65) Prior Publication Data

US 2023/0200444 A1 Jun. 29, 2023

(30) Foreign Application Priority Data

Dec. 23, 2021 (CN) ..... 202123271702.8

(51) Int. Cl.

| | |
|---|---|
| ***A24F 40/46*** | (2020.01) |
| ***A24F 40/20*** | (2020.01) |
| ***A24F 40/40*** | (2020.01) |
| ***A24F 40/42*** | (2020.01) |
| ***A24F 40/50*** | (2020.01) |
| ***A24F 40/51*** | (2020.01) |
| ***A24F 40/53*** | (2020.01) |
| ***A24F 40/60*** | (2020.01) |

(52) U.S. Cl.

CPC ..... *A24F 40/46* (2020.01); *A24F 40/42* (2020.01); *A24F 40/50* (2020.01); *A24F 40/51* (2020.01); *A24F 40/53* (2020.01); *A24F 40/60* (2020.01); *A24F 40/20* (2020.01); *A24F 40/40* (2020.01)

(58) Field of Classification Search

CPC .. A24F 40/51; A24F 40/60; A24F 1/30; F24H 3/08

See application file for complete search history.

(56) References Cited

U.S. PATENT DOCUMENTS

2017/0251718 A1* 9/2017 Armoush ..... A24F 1/30

* cited by examiner

*Primary Examiner* — Christopher M Rodd
*Assistant Examiner* — Jennifer A Kessie

(57) ABSTRACT

The present application relates to a field of electronic atomizing technology, especially provides an atomizer comprising a heating assembly, an atomizing assembly, a connecting assembly and a power supply assembly; the heating assembly includes a tobacco container, a hollow air path structure and a heating element; the atomizing assembly includes a fixed housing internally provided with a conducting element; an inserting interface is defined in a lateral surface of the fixed housing; the connecting assembly includes a first connector, a second connector and a connecting wire; the power supply assembly includes a battery housing and a battery. The atomizer adopts a split design, and each part can be disassembled and carried separately. Through the connecting wire, a distance between the heating assembly and the power supply assembly is lengthened, a service life of the power supply assembly is prolonged, and a damaged part can be replaced separately.

7 Claims, 8 Drawing Sheets

ATOMIZER

CROSS REFERENCE TO RELATED APPLICATIONS

The present application claims the benefit of Chinese Patent Application No. 202123271702.8 filed on Dec. 23, 2021, the contents of which are incorporated herein by reference in their entirety.

TECHNICAL FIELD

The present application relates to a field of electronic atomizing technology, especially relates to a split type atomizer configured for smoking a hookah.

BACKGROUND

At present, electronic atomizers mostly adopt a ceramic plate heating mode or an electromagnetic induction heating mode to atomize atomized materials to produce vapor. When electromagnetic induction heating is adopted, due to large heating power as required and insufficient battery utilization, it is often necessary to increase battery capacity, thus, overall dimensions of products get larger, which adversely affect using and carrying the products. In addition, an atomizing assembly and a power supply of conventional electronic atomizers are mostly integrally designed. The power supply is close to a heating assembly. The power supply is easy to be more rapidly damaged at a higher temperature for a long time, which shortens a service life of the atomizer. When the atomizer is out of order, the atomizer needs to be integrally disassembled for maintenance or replacement. The atomizer is difficult to disassemble and assemble and often needs to be replaced as a whole, which increases use cost of the atomizer.

SUMMARY

By providing a tobacco evaporator, the application solves the technical problem of Based on this, it is necessary to provide a split type atomizer configured for smoking a hookah, aiming at technical problems of inconvenience to carry due to large dimensions, short service life of power supply and difficulty in disassembly, assembly and maintenance.

An atomizer is provided, and the atomizer comprises:

a heating assembly, wherein the heating assembly includes a tobacco container, a hollow air path structure connected to an inner chamber of the tobacco container and a heating element accommodated in the inner chamber of the tobacco container or mounted on an outer surface of the tobacco container;

an atomizing assembly, wherein the atomizing assembly includes a fixed housing sleeved on the tobacco container and connected to the hollow air path structure; and a conducting element electrically connected to the heating element is provided in an inner chamber of the fixed housing, and an inserting interface is defined in a lateral surface of the fixed housing;

a connecting assembly, wherein the connecting assembly includes a first connector, a second connector and a connecting wire electrically connecting the first connector to the second connector; the first connector is inserted in the inserting interface and electrically connected to the conducting element; and a power supply assembly, wherein the power supply assembly includes a battery housing and a battery accommodated in the battery housing; and a charging interface connected to the battery and configured for inserting the second connector is defined in the battery housing.

In an embodiment, the hollow air path structure extends along two sides of a bottom portion of the tobacco container and includes a first air passage defined in an extending way in the inner chamber of the tobacco container and a second air passage extending away from the outside of the bottom portion of the tobacco container and communicating with the first air passage.

In another embodiment, the heating element is arranged on the outside of the bottom portion of the tobacco container.

In another embodiment, the heating element is arranged in the inner chamber of the tobacco container.

In another embodiment, an air hole is defined in a bottom portion or a lateral surface of the tobacco container; the hollow air path structure is connected to the air hole; and the heating element is arranged on an outer lateral surface of the tobacco container.

In another embodiment, a dummy load and a first micro control element electrically connected to the dummy load are arranged on the tobacco container or the fixed housing; the first micro control element is connected to the conducting element; and the battery housing is internally provided with a second micro control element configured for measuring resistance value of the dummy load or identifying type information of the dummy load; when the second micro control element obtains the resistance value information or the type information, the heating element is controlled to heat at a preset power and temperature.

In another embodiment, the first micro control element is electrically connected to or communicates with the second micro control element through the connecting wire; the first micro control element measures the resistance value of the dummy load and delivers it to the second micro control element.

In another embodiment, when the first micro control element is electrically connected to the second micro control element, the second micro control element determines the type of the heating assembly according to the received resistance value information of the dummy load and enters a preset heating mode; when the first micro control element communicates with the second micro control element, and the resistance value of the dummy load delivered by the first micro control element reaches a threshold preset by the second micro control element, the second micro control element sends instructions to the dummy load and receives data delivered by the dummy load to identify the type of the heating assembly.

In another embodiment, a connecting pipe is inserted on a bottom portion of the fixed housing; and the connecting pipe is configured for cooperating with an air path inlet of an external hookah.

In another embodiment, a voice device electrically connected to the second micro control element is provided on the battery housing; and the voice device receives information delivered by the second micro control element and plays audio of predetermined content to indicate heating status of the atomizer.

Through implementing the atomizer of the present application and adopting a split type design of the heating assembly, the atomizing assembly, the connecting assembly and the power supply assembly, when the atomizer is carried or transported, each part can be disassembled and carried separately, which reduces the difficulty of carrying. By the connecting way via the connecting wire, the distance between the heating assembly and the power supply assembly is prolonged, which avoids the damage of the power supply assembly caused by the heating assembly baking the power supply assembly for a long time and is conducive to prolonging the service life of the power supply assembly. Moreover, the split type arrangement reduces the difficulty of disassembling and assembling the atomizer. When some elements of the atomizer are damaged, the damaged elements can be replaced separately without replacing the whole machine, which reduces the use cost and maintenance difficulty of the atomizer. In addition, the present application provides a design of the exterior power supply assembly with the largest weight, which reduces the load-bearing of the hookah and can prevent the atomizer from falling or damaging the body of the hookah.

DETAILED DESCRIPTION OF THE PREFERRED EMBODIMENT

In order to make the above objects, features and advantages of the present application more obvious and easier to understand, the specific embodiments of the present application are described in detail below in combination with the accompanying drawings. the specific features are detailed in the following description to facilitate fully understanding the present application. However, the present application can be implemented in other ways different from the described herein. The skilled in the art can make similar improvements without violating the connotation of the present application. Therefore, the present application is not limited by the specific embodiments disclosed below.

Figure 1:
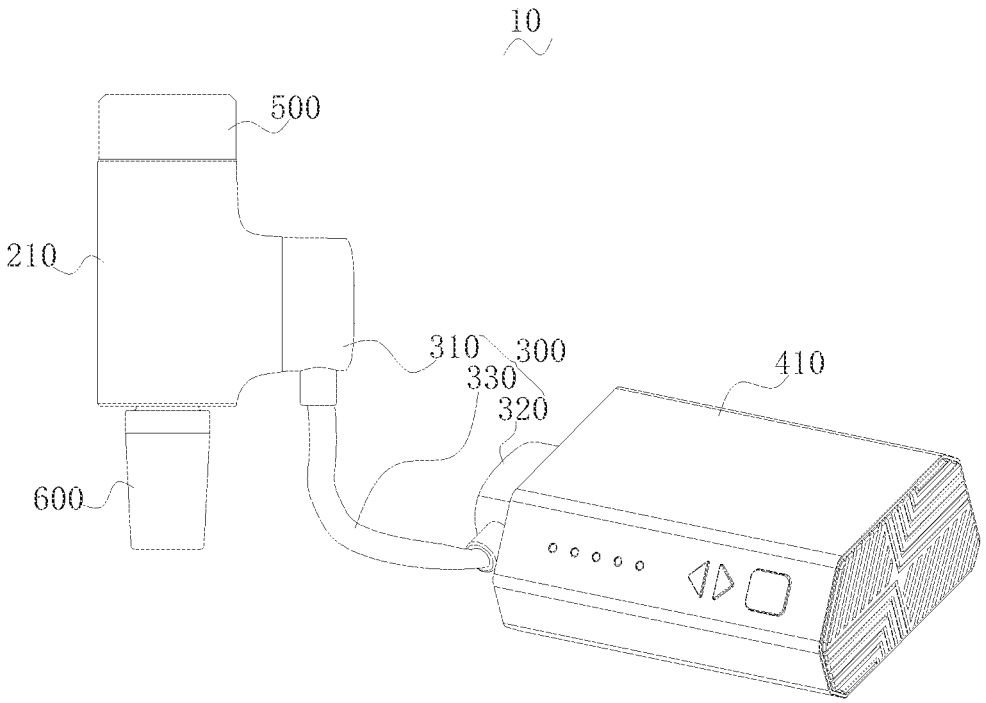
FIG. 1 is a structural schematic view of an atomizer provided in an embodiment of the present application.

As shown in FIG. 1, the present application provides a split type atomizer 10 configured for smoking a hookah; the atomizer 10 is improved compared with the conventional atomizers 10 integrally designed with a power supply assembly 400, an atomizing assembly 200 and a heating assembly 100. Specifically, the heating assembly 100 is integrally assembled with the atomizing assembly 200, and the atomizing assembly 200 is connected to the power supply assembly 400 via a connecting assembly 300 arranged out of the atomizing assembly 200. The connecting assembly 300 respectively cooperates with the atomizing assembly 200 and the power supply assembly 400 through an inserting connection mode, i.e., the atomizer 10 is a modular structure which is easy to disassemble and assemble. Thus, when some parts are out of order, the faulty parts can be replaced separately, the other parts still are used, which can remarkably reduce use cost of the atomizer 10.

Specifically, as shown in FIG. 1-FIG. 5 and FIG. 10, the atomizer 10 of the present embodiment comprises the heating assembly 100, the atomizing assembly 200, the connecting assembly 300 and the power supply assembly 400; the heating assembly 100 includes a tobacco container 110, a hollow air path structure 120 connected to an inner chamber of the tobacco container 110 and a heating element 130 accommodated in the inner chamber of the tobacco container 110 or mounted on an outer surface of the tobacco container 110. The atomizing assembly 200 includes a fixed housing 210 sleeved on the tobacco container 110 and connected to the hollow air path structure 120; a conducting element electrically connected to the heating element 130 is provided in an inner chamber of the fixed housing 210; an inserting interface 220 is defined in a lateral surface of the fixed housing 210; the connecting assembly 300 includes a first connector 310, a second connector 320 and a connecting wire 330 electrically connecting the first connector 310 to the second connector 320; the first connector 310 is inserted in the inserting interface 220 and electrically connected to the conducting element; and a PCB 340 is internally arranged in the first connector 310, and the PCB 340 is configured to provide connecting portions between electrical wires in the atomizing assembly 200 and internal electrodes in the first connector 310 for the convenience of welding the electrical wires to the electrodes. The power supply assembly 400 includes a battery housing 410 and a battery 420 accommodated in the battery housing 410; and a charging interface 430 connected to the battery 420 and configured for inserting the second connector 320 is defined in the battery housing 410. In use process of the atomizer 10, medicine such as tobacco shred, tobacco oil or tobacco paste, etc., to be heated is placed in the tobacco container 110, and the second connector 320 accesses a voltage via the charging interface 430, and the voltage is transferred to the heating element 130 via the connecting wire 330, the first connector 310 and the conducting element to make the heating element 130 work and be heated. As the heating element 130 is heated, the tobacco container 110 is affected by heat conduction and radiation, the temperature in the inner chamber of the tobacco container 110 is raised, and the medicine is baked, so that active ingredients in the medicine evaporate. Because the hollow air path structure 120 is directly connected to the fixed housing 210 of the atomizing assembly 200, the evaporated vapor is directly discharged through an air flow passage in the fixed housing 210 under action of external breathing forces for users to smoke.

Figure 2:
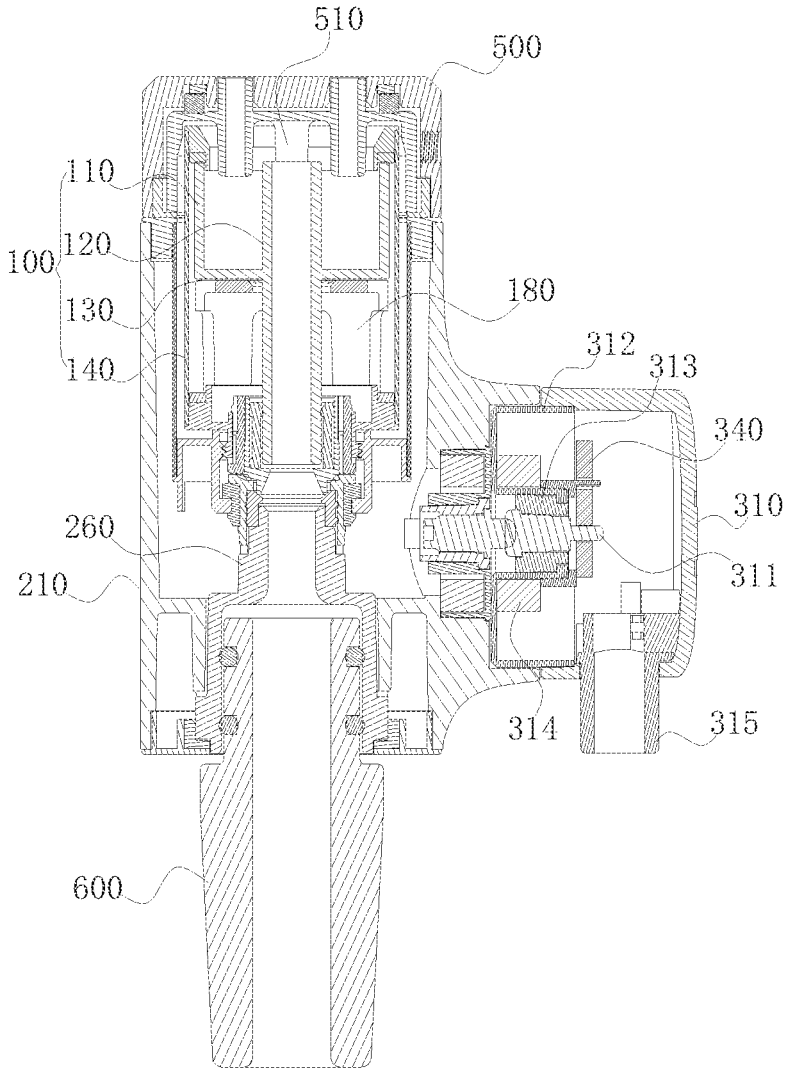
FIG. 2 is a partial sectional structural schematic view of the atomizer provided in the embodiment of the present application.
Figure 3:
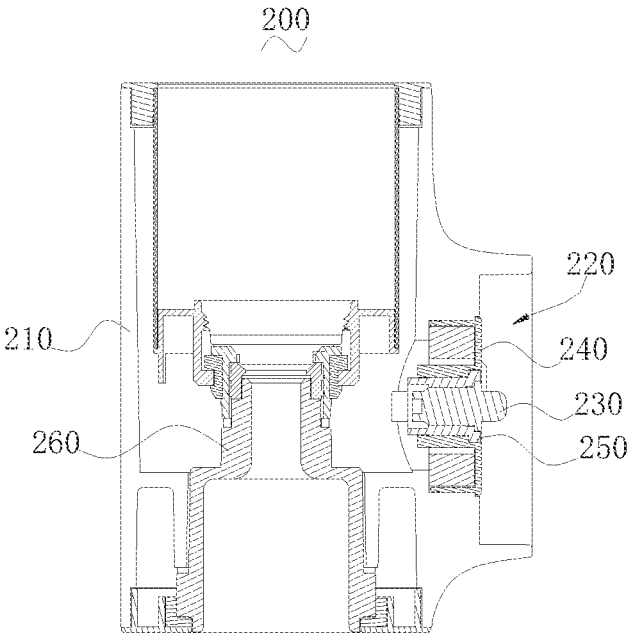
FIG. 3 is a sectional structural schematic view of an atomizing assembly provided in the embodiment of the present application.
Figure 4:
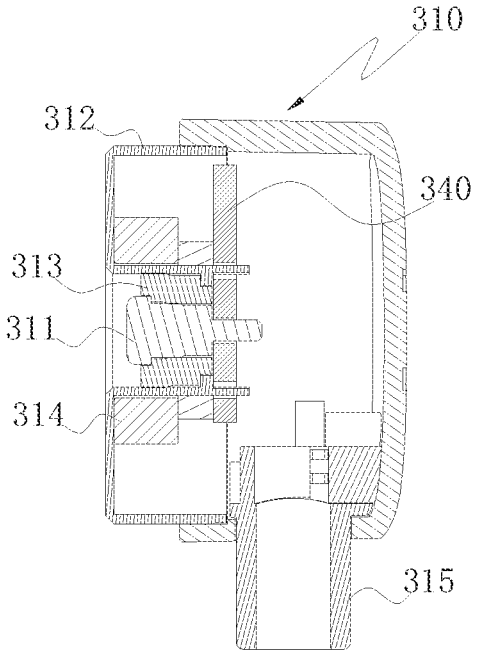
FIG. 4 is a sectional structural schematic view of a first connector provided in the embodiment of the present application.
Figure 5:
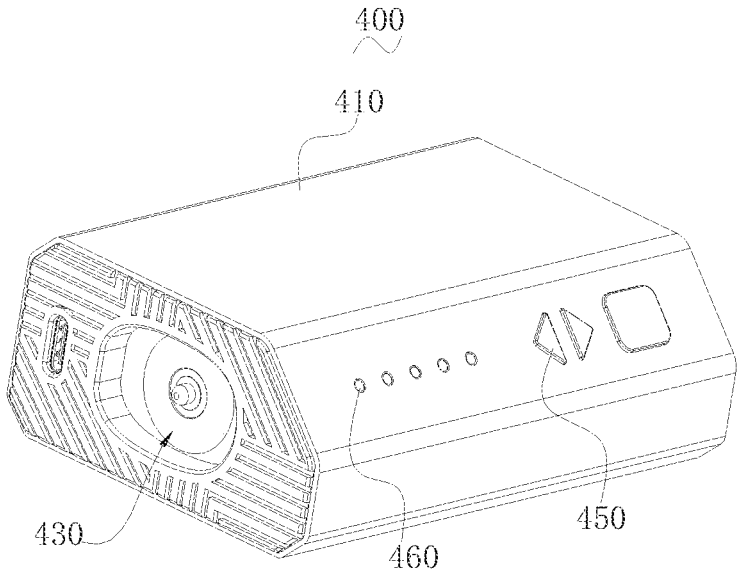
FIG. 5 is a structural schematic view of a power supply assembly provided in the embodiment of the present application.
Figure 6:
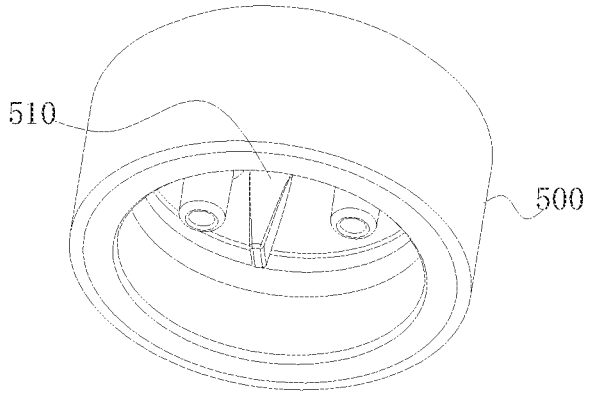
FIG. 6 is a structural schematic view of an atomizer cover of a heating assembly provided in the embodiment of the present application.

As shown in FIG. 1 and FIG. 2, the heating assembly 100 further includes a heating core housing 140 sleeved on the outer surface of the tobacco container 110; the fixed housing 210 of the atomizing assembly 200 is sleeved on the heating core housing 140, and the heating core housing 140 is configured for protecting the tobacco container 110. Advantageously, the heating core housing 140 adopts thermal insulation materials to keep heat in the tobacco container 110 from getting out, i.e., play the role of heat preservation to improve energy utilization efficiency of the atomizer 10. Furthermore, as shown in FIG. 2, FIG. 6 and FIG. 7, the heating assembly 100 further includes an atomizer cover 500; an opening is defined in a top portion of the tobacco container 110, the atomizer cover 500 is mounted on the top portion of the tobacco container 110, and a lower edge of the atomizer cover 500 is resisted by an upper edge of the fixed housing 210 to form a closed air passage in the tobacco container 110, which prevents a problem of smoke channeling when the atomizer 10 is used, improves usage experience of the atomizer 10 and reduces difficulty in cleaning the atomizer 10.

Figure 7:
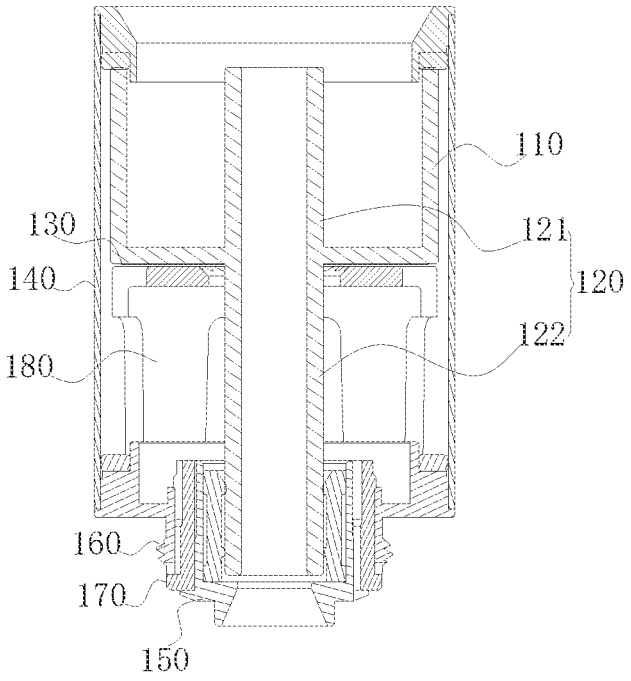
FIG. 7 is a sectional structural schematic view of the heating assembly provided in the embodiment of the present application.

As shown in FIG. 7, in one embodiment, the heating assembly 100 further includes a first internal electrode 150 mounted on the periphery of a bottom portion of the hollow air path structure 120 and a first external electrode 160 isolatedly provided with the first internal electrode 150. The first internal electrode 150 and the first external electrode 160 are electrically connected to two end portions of the heating element 130 respectively by wires. Advantageously, a first insulating ring 170 is provided between the first internal electrode 150 and the first external electrode 160; and the first external electrode 160 is disposed on a bottom portion of the heating core housing 140 and resisted by an internal surface of the heating core housing 140. An insulation bracket 180 is provided between a bottom portion of the tobacco container 110 and the first external electrode 160, which is configured for supporting the tobacco container 110, blocks a heat transfer passage, and prevents heat loss to improve evaporation efficiency.

The hollow air path structure 120 of the atomizer 10 in the present application has three forms, the hollow air path structure 120 of three different structures are described in detail below.

As shown in FIG. 7, in one embodiment, the hollow air path structure 120 extends along two sides of the bottom portion of the tobacco container 110 and includes a first air passage 121 defined in an extending way in the inner chamber of the tobacco container 110 and a second air passage 122 extending away from the outside of the bottom portion of the tobacco container 110 and communicating with the first air passage 121. Advantageously, a top portion of the first air passage 121 is flush with the top portion of the tobacco container 110. Thus, when the medicine is placed on an internal bottom portion of the tobacco container 110 and heated, smoke generated by heating the medicine moves from the bottom portion of the tobacco container 110 to the top portion of the tobacco container 110, and then is discharged from the top portion of the tobacco container 110 via the hollow air path structure 120. Hence, the time of which the smoke stays in the tobacco container 110 and the hollow air path structure 120 is prolonged to make the smoke be mixed more uniformly, so that the taste of the smokes is uniform.

Specifically, the heating element 130 is arranged on the outside of the bottom portion of the tobacco container 110, i.e., the heating element 130 is arranged between the bottom portion of the tobacco container 110 and a top portion of the insulation bracket 180, and can directly heat the outer surface of the tobacco container 110, which is not only convenient for cleaning the tobacco container 110, but also makes the evaporated vapor being breathed in a user not contact the heating element 130, so that metal ions generated by a temperature rise of the heating element 130 is prevented from being breathed in to reduce the risk to the user's health and be safer. Moreover, the heating element 130 is in close contact with the outside of the bottom portion of the tobacco container 110, which can prevent heat loss and improve the evaporation efficiency.

Figure 8:
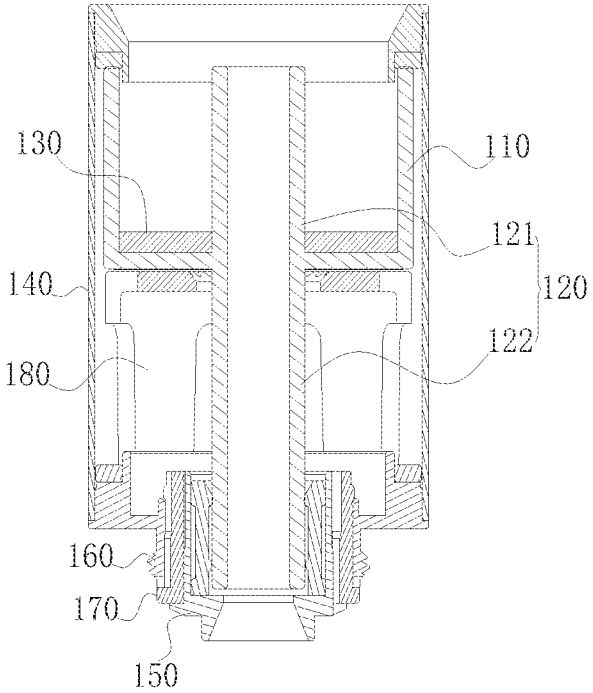
FIG. 8 is a sectional structural schematic view of a heating assembly provided in another embodiment of the present application.

As shown in FIG. 8, in another embodiment, as the hollow air path structure 120 extends along the two sides of the bottom portion of the tobacco container 110, the heating element 130 is arranged in the inner chamber of the tobacco container 110. Advantageously, the heating element 130 is disposed on an internal bottom surface of the tobacco container 110. Thus, In the use process of the atomizer 10, the medicine is placed on the heating element 130 and directly heated by the exothermic heating element 130, which shortens the heating time of the medicine and can significantly improve the evaporation efficiency of the medicine and reduce the heat loss.

It should be noted, as the hollow air path structure 120 extends along the two sides of the bottom portion of the tobacco container 110, a wedge block 510 extending along a direction towards an opening of the atomizer cover 500 is arranged on the atomizer cover 500. When the atomizer cover 500 is mounted on the heating core housing 140 and rotates, the wedge block 510 can stir raw materials (medicine) to make the raw materials be heated uniformly. In the present embodiment, an air intake column is arranged between the atomizer cover 500 and the heating core housing 140, and a top portion of the air intake column is lower than a top portion of hollow air path structure 120, which avoids guiding the air from the air intake column to the hollow air path structure 120 directly and the difficulty of the smoke in the tobacco container 110 being led to the hollow air path structure 120 by the air to ensure the reliability of the atomizer 10.

Figure 9:
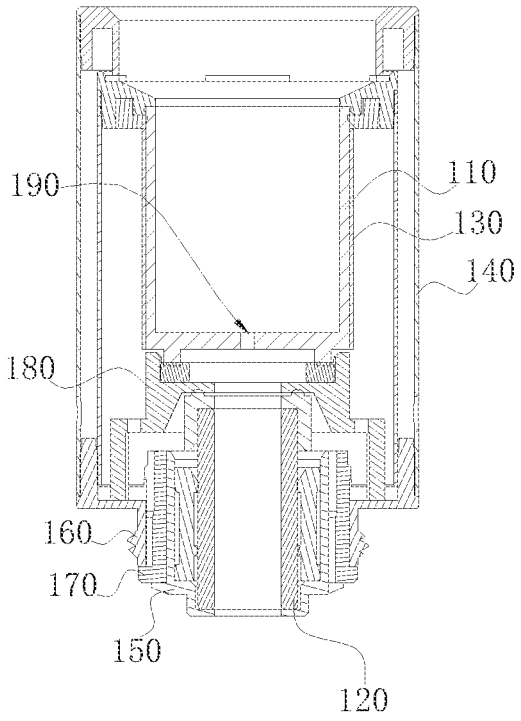
FIG. 9 is a sectional structural schematic view of a heating assembly provided in another embodiment of the present application.

In another embodiment, an air hole 190 is defined in the bottom portion or a lateral surface of the tobacco container 110; the hollow air path structure 120 is connected to the air hole 190; and the heating element 130 is arranged on an outer lateral surface of the tobacco container 110. As shown in FIG. 9, FIG. 9 shows a situation that the air hole 190 is defined in the center portion of the bottom portion of the tobacco container 110. In this situation, the top portion of the hollow air path structure 120 is resisted by the outside of the bottom portion of the tobacco container 110, and the hollow air path structure 120 is connected to the air hole 190 to form a smoke passage. Under this situation, the bottom portion of the tobacco container 110 is resisted by the hollow air path structure 120, the heating element 130 is arranged on the outer lateral surface of the tobacco container 110 to heat the tobacco container 110, so that the medicine is isolated from the heating element 130 to reduce difficulty of cleaning the tobacco container 110 and the hollow air path structure 120. Obviously, as the hollow air path structure 120 is arranged on the bottom portion of the tobacco container 110, the heating element 130 can be arranged in the inner chamber of the tobacco container 110, which is not detailed here.

In above three different embodiments, the heating element 130 can be a heating plate, a heating wire or another heating power supply, correspondingly, the heating element 130 is sheet-shaped and lies on the outer lateral surface or an internal surface of the tobacco container 110, and the heating element 130 also can be a ring-shaped structure, a helical structure or a wave-shaped structure to enlarge the heating area of the tobacco container 110, which improve a heating effect.

The conducting element includes a second internal electrode 230 electrically connected to the first internal electrode 150 and a second external electrode 240 electrically connected to the first external electrode 160, and a second insulating ring 250 is arranged between the second internal electrode 230 and the second external electrode 240. An internal electrode 311 and an external electrode 312 respectively correspondingly electrically connected to the second internal electrode 230 and the second external electrode 240 are arranged on the first connector 310, and an insulating ring 313 is arranged between the internal electrode 311 and the external electrode 312. In the present embodiment, each one of the internal electrodes and external electrodes is respectively a ring-shaped structure. Furthermore, a magnet 314 is mounted on a portion corresponding to the inserting interface 220 of the first connector 310, likewise, a ferromagnetic body cooperating with the magnet 314 is internally arranged in the inserting interface 220. Thus, when first connector 310 is close to the inserting interface 220, the first connector 310 is adsorbed into the inserting interface 220 in a magnetic field and limitedly cooperates with an internal surface of the inserting interface 220, which reduces the inserting difficulty of the first connector 310, improves firmness of the first connector 310 matching the inserting interface 220, and ensures the reliability of atomizer 10. In one embodiment, a clamping element 315 is arranged on a bottom portion of an outer housing of the first connector 310; the clamping element 315 is sleeved on the connecting wire 330, and configured for reinforcing the connections between the connecting wire 330, second internal electrode 230 and the second external electrode 240 to ensure that turning a circuit on or off is reliable.

As shown in FIG. 1 and FIG. 2, a connecting pipe 600 is inserted on a bottom portion of the fixed housing 210; and the connecting pipe 600 is configured for cooperating with an air path inlet of an external hookah. Specifically, a fixed seat 260 being a stepped tubular structure is internally arranged in the fixed housing 210. A top portion of the fixed seat 260 is a small diameter end portion, and a bottom portion of the fixed seat 260 is a big diameter end portion, the bottom portion of the hollow air path structure 120 is inserted in the small diameter end portion of the fixed seat 260 and communicates with an inner chamber of the fixed seat 260; and a top portion of the connecting pipe 600 is inserted in the big diameter end portion of the fixed seat 260 and communicates with the inner chamber of the fixed seat 260, so that the smoke in the hollow air path structure 120 is guided into the hookah to form a complete smoke passage. Advantageously, the fixed seat 260 is supported by a ceramic body to ensure that the hollow air path structure 120 smells not peculiar and keep the hollow air path structure 120 clean. Soft sealing structures are respectively arranged on a portion of the fixed seat 260 cooperating with the hollow air path structure 120 and a portion of the fixed seat 260 cooperating with the connecting pipe 600, so that the smoke is prevented from extending along gaps between the fixed seat 260, the hollow air path structure 120 and the connecting pipe 600 to reduce the difficulty in cleaning the atomizer 10 and weaken the influence of the smoke to the internal structure of the atomizer 10. Specifically, a silicone body is sleeved on the top portion of the fixed seat 260, and the first internal electrode 150 is resisted by the silicone body to achieve a sealing connection of the atomizing assembly 200.

It should be noted, the atomizer 10 of the present application adopts a split type structure, and the heating assembly 100 and the atomizing assembly 200 are combinable structures. Therefore, under the condition of meeting size and shape, various heating assemblies 100 can be used to cooperate with the atomizing assembly 200. For example, the heating assemblies 100 with the above three different structures can be used to cooperate with the atomizing assembly 200, and the medicine is heated and evaporated. Because in the above three heating assemblies 100, the relative positions of the heating element 130 and the tobacco container 110 are different, the heating conditions of the medicine in the tobacco container 110 are obviously different, and the temperature and heating power etc. required by heating the medicine also need to be adjusted accordingly. In the present embodiment, an identification element configured for identifying different types of the heating assemblies 100 is further disclosed. By sensing the different types of the heating assemblies 100, the heating element 130 is controlled to work at different powers and heating temperatures, so that the different types of the heating assemblies 100 can meet the evaporation operation of the medicine.

Figure 10:
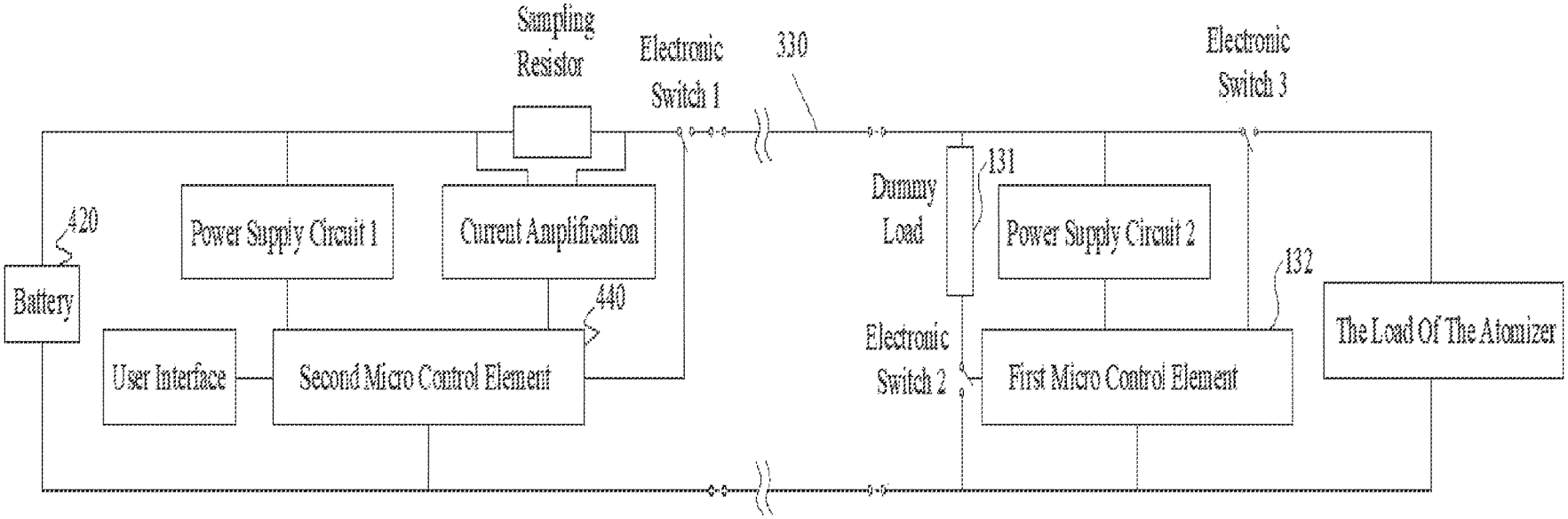
FIG. 10 is a circuit principle structural schematic view of the atomizer provided in the embodiment of the present application.

As shown in FIG. 10, a dummy load 131 and a first micro control element 132 electrically connected to the dummy load 131 are arranged on the tobacco container 110 or the fixed housing 210; the first micro control element 132 is connected to the conducting element (not shown in Figures); and the battery housing 410 is internally provided with a second micro control element 440 configured for measuring the resistance value of the dummy load 131 or identifying the type information of the dummy load 131; when the second micro control element 440 obtains the resistance value information or the type information, the heating element 130 is controlled to heat at a preset power and temperature. Advantageously, the dummy load 131 is arranged in the fixed housing 210 to prevent the high temperature in the tobacco container 110 from adversely affecting the service life of the dummy load 131. Further, the first micro control element 132 is electrically connected to or communicates with the second micro control element 440 through the connecting wire 330; the first micro control element 132 measures the resistance value of the dummy load 131 and delivers it to the second micro control element 440. When the first micro control element 132 is electrically connected to the second micro control element 440, the second micro control element 440 determines the type of the heating assembly 100 according to the received resistance value information of the dummy load 131 and enters a preset heating mode; when the first micro control element 132 communicates with the second micro control element 440, and the resistance value of the dummy load 131 delivered by the first micro control element 132 reaches a threshold preset by the second micro control element 440, the second micro control element 440 sends instructions to the dummy load 131 and receives data delivered by the dummy load 131 to identify the type of the heating assembly 100.

In the present embodiment, the resistance value of the dummy load 131 of each type of the heating assemblies 100 is within different ranges and the type of the heating assembly 100 can be determined by measuring the resistance value of the dummy load 131. Specifically, as the first micro control element 132 is electrically connected to the second micro control element 440 (i.e., the type of the heating assembly 100 is directly identified according to the resistance value of the dummy load 131), when the machine is off or before the beginning of heating, the electronic switch 1 is off-state, and the heating assembly 100 does not work without accessing a power supply. The user operates the machine to start a heating function, the electronic switch 1 is turned on, the electronic switch 2 is on by default and the electronic switch 3 is off by default before the first micro control element 132 does not work normally. The power supply circuit 2 of the heating assembly 100 supplies power to the first micro control element 132, and the first micro control element 132 controls the electronic switch 2 to be turned on and controls the electronic switch 3 to be turned off at the same time. Then, the battery 420 discharges via the sampling resistor, the electronic switch 1, the connecting wire 330, the dummy load 131 and the electronic switch 2. The voltage drop on the sampling resistor is amplified by the current amplifier and sent to the second micro control element 440 for sampling. The second micro control element 440 measures the resistance value of the dummy load 131 based on the voltage of the battery 420 and the voltage drop of the sampling resistor. When the first micro control element 132 of the heating assembly 100 estimates that the power supply assembly 400 has completed the resistance measurement of the dummy load 131 (a timer can be arranged in the first micro control element 132, and time signals delivered by the timer are received, when the predetermined time is checked, it is determined that the resistance measurement of the dummy load 131 is completed), the electronic switch 2 is controlled to be turned off, the dummy load 131 is not on, The electronic switch 3 is controlled to be turned on so that the load of the atomizer 10 can work. So far, the identification of the heating assembly 100 is completed.

After the identification of the heating assembly 100 is completed, the second micro control element 440 starts the corresponding heating program according to the identified type of heating assembly 100, and the electronic switch 1 is controlled to be turned on and off to control the working state such as power and temperature i.e., of the heating element 130. During the process of heating and maintaining the temperature of the heating assembly 100, the first micro control element 132 continuously controls the electronic switch 2 to be off to make the dummy load 131 be off, and continuously controls the electronic switch 3 to be on until the power supply assembly 400 controls the electronic switch 1 to be turned off and ends a heating process. When the first micro control element 132 is not attached to the power supply, the heating assembly 100 returns to the default state.

When the first micro control element 132 communicates with the second micro control element 440 (i.e., the type of the heating assembly 100 is identified through data communication), the resistance value of the dummy load 131 used for identification is different from the specific resistance value of the load of the atomizer 10, and the power supply assembly 400 starts the communication program when sensing the load of the resistance value, and identifies information such as the type of heating assembly 100 etc. included in the data after receiving the data sent by the dummy load 131. That is, in this situation, the resistance value of the dummy load 131 is only used as the condition for triggering the data communication identification. The resistance values of the dummy loads 131 of different types of the heating assemblies 100 are the same. Moreover, the type information of the heating assembly 100 saved in each dummy load 131 is different so as to identify the type of the heating assembly 100. The data connection of the present embodiment and the electrical connection between the first micro control element 132 and the second micro control element 440 in the previous embodiment can adopt the same connecting wire, that is, the connecting wire can realize both the electrical connection and the data communication, and whether to enter resistance identification or data communication identification only depends on whether the resistance condition triggering data communication identification is reached.

Specifically, in the case that the data communication identification is adopted, when the machine is turned off or before the beginning of heating, the electronic switch 1 is off-state, and the heating assembly 100 does not work without accessing a power supply. The user operates the machine to start a heating function, the electronic switch 1 is turned on, the electronic switch 2 is on by default and the electronic switch 3 is off by default before the first micro control element 132 does not work normally. The power supply circuit 2 of the heating assembly 100 supplies power to the first micro control element 132, and the first micro control element 132 controls the electronic switch 2 to be turned on and controls the electronic switch 3 to be turned off at the same time. Then, the battery 420 discharges via the sampling resistor, the electronic switch 1, the connecting wire 330, the dummy load 131 and the electronic switch 2. The voltage drop on the sampling resistor is amplified by the current amplifier and sent to the second micro control element 440 for sampling. The second micro control element 440 measures the resistance value of the dummy load 131 based on the voltage of the battery 420 and the voltage drop of the sampling resistor, and wait for the heating assembly 100 delivering data.

When the first micro control element 132 of the heating assembly 100 estimates that the power supply assembly 400 has completed the resistance measurement of the dummy load 131 (a timer can be arranged similarly, it is determined whether the measurement is completed or not by measuring time length), the data including information such as the type of the heating assembly 100 etc. is started to be transferred to the power supply assembly 400 through the connecting wire 330. When the data is transferred, the electronic switch 2 is controlled to be turned off and on according to the binary value of the transferred data. Each binary value 0 or 1 respectively controls the electronic switch 2 to be off or on with the same time interval dt. After the second micro control element 440 achieves transferring the data, the electronic switch 3 is controlled to be turned on so that the load of the atomizer 10 (i.e., the heating element 130) can work. In the present embodiment, the second micro control element 440 of the power supply assembly 400 determines whether the dummy load 131 is on or off by measuring the voltage drop on the sampling resistor, and determines the on and off state of the dummy load 131 according to the timing sequence with the same time interval dt so as to restore the data sent by the heating assembly 100, and determines the type of the heating assembly 100 and the initial resistance value of the load of the atomizer 10 according to the obtained data, That is, the identification of the type of heating assembly 100 is completed.

After the heating assembly 100 is identified, the second micro control element 440 starts the corresponding heating program according to the type of the heating assembly 100, and the electronic switch is controlled to be turned on and off to control the working state such as power and temperature etc. of the heating assembly 100. During the process of heating and maintaining the temperature of the heating assembly 100, the second micro control element 440 continuously controls the electronic switch 2 to be off to make the dummy load 131 be off, and continuously controls the electronic switch 3 to be on until the power supply assembly 400 controls the electronic switch 1 to be turned off and ends a heating process. When the second micro control element 440 is not attached to the power supply, the heating assembly 100 returns to the default state.

It should be further described that in the present embodiment, under the factory mode of the atomizer 10, during the process of the second micro control element 440 receiving the type data information delivered by the heating assembly 100, the second micro control element 440 of the power supply assembly 400 sends the initial resistance value of the measured load of the atomizer 10 to the heating assembly 100 by controlling the on and off state of the electronic switch 1, the first micro control element 132 of the heating assembly 100 saves the data in a nonvolatile memory after measuring the data delivered by the power supply assembly 400. The data can still be retained after the heating assembly 100 is powered off. In practical application, the resistance value of the load of the atomizer 10 is included in the data sent by the heating assembly 100 operated in the factory mode to the second micro control element 440, so that the second micro control element 440 can control the temperature and power of the atomizer 10 according to the initial resistance value of the heating element 130.

In one embodiment, a voice device electrically connected to the second micro control element 440 is provided on the battery housing 410; and the voice device receives information delivered by the second micro control element 440 and plays audio of predetermined content to indicate heating status of the atomizer. Specifically, the voice device is a speaker, which is accommodated in the inner chamber of the battery housing 410, and the audio output port of the voice device is located at outside of the battery housing 410. When the second micro control element 440 controls the heating element 130 to heat for the predetermined time or controls the heating element 130 reaches the preset heating temperature, the second micro control element 440 sends instructions to the voice device to play audio and prompt the user. Furthermore, the battery housing 410 is provided with a plurality of switches or hand control elements 450 electrically connected to the second micro control element 440 and used to send operation instructions to the second micro control element 440, and is further provided with an indicating light 460 for displaying a working state of the power supply assembly 400, so that the user can operate the atomizer 10 and realize the working state of the atomizer 10.

Through implementing the atomizer 10 of the present application and adopting a split type design of the heating assembly 100, the atomizing assembly 200, the connecting assembly 300 and the power supply assembly 400, when the atomizer 10 is carried or transported, each part can be disassembled and carried separately, which reduces the difficulty of carrying. By the connecting way via the connecting wire 330, the distance between the heating assembly 100 and the power supply assembly 400 is prolonged, which avoids the damage of the power supply assembly 400 caused by the heating assembly 100 baking the power supply assembly 400 for a long time and is conducive to prolonging the service life of the power supply assembly 400. Moreover, the split type arrangement reduces the difficulty of disassembling and assembling the atomizer 10. When some elements of the atomizer 10 are damaged, the damaged elements can be replaced separately without replacing the whole machine, which reduces the use cost and maintenance difficulty of the atomizer 10. In addition, the present application provides a design of the exterior power supply assembly 400 with the largest weight, which reduces the load-bearing of the hookah and can prevent the atomizer from falling or damaging the body of the hookah.

The technical features of the above embodiments can be combined arbitrarily. In order to make the description concise, all possible combinations of the technical features in the above embodiments are not described. However, as long as there is no contradiction in the combination of these technical features, it should be considered to be in the scope recorded in the specification.

The above embodiments only show several ways of implementation of the present application, and the description is more specific and detailed, but it cannot be understood as a limitation of the scope of the present application. It should be noted that for the skilled in the art, several modifications and improvements can be made without departing from the principle of the present application, which belong to the protection scope of the present application. Therefore, the protection scope of the present patent application should be subject to the appended claims.

What is claimed is:

1. An atomizer, comprising:

a heating assembly, wherein the heating assembly includes a tobacco container, a hollow air path structure connected to an inner chamber of the tobacco container and a heating element accommodated in the inner chamber of the tobacco container or mounted on an outer surface of the tobacco container;

an atomizing assembly, wherein the atomizing assembly includes a fixed housing sleeved on the tobacco container and connected to the hollow air path structure; and a conducting element electrically connected to the heating element is provided in an inner chamber of the fixed housing, and an inserting interface is defined in a lateral surface of the fixed housing;

a connecting assembly, wherein the connecting assembly includes a first connector, a second connector and a connecting wire electrically connecting the first connector to the second connector; the first connector is inserted in the inserting interface and electrically connected to the conducting element; and a power supply assembly, wherein the power supply assembly includes a battery housing and a battery accommodated in the battery housing; and a charging interface connected to the battery and configured for inserting the second connector is defined in the battery housing;

a dummy load and a first micro control element electrically connected to the dummy load are arranged on the tobacco container or the fixed housing; the first micro control element is connected to the conducting element; and the battery housing is internally provided with a second micro control element configured for measuring resistance value of the dummy load or identifying type information of the dummy load; when the second micro control element obtains the resistance value information or the type information, the heating element is controlled to heat at a preset power and temperature;

the first micro control element is electrically connected to or communicates with the second micro control element through the connecting wire; the first micro control element measures the resistance value of the dummy load and delivers it to the second micro control element;

when the first micro control element is electrically connected to the second micro control element, the second micro control element determines the type of the heating assembly according to the received resistance value information of the dummy load and enters a preset heating mode; when the first micro control element communicates with the second micro control element, and the resistance value of the dummy load delivered by the first micro control element reaches a threshold preset by the second micro control element, the second micro control element sends instructions to the dummy load and receives data delivered by the dummy load to identify the type of the heating assembly.

2. The atomizer of claim 1, wherein the hollow air path structure extends along two sides of a bottom portion of the tobacco container and includes a first air passage defined in an extending way in the inner chamber of the tobacco container and a second air passage extending away from the outside of the bottom portion of the tobacco container and communicating with the first air passage.

3. The atomizer of claim 2, wherein the heating element is arranged on the outside of the bottom portion of the tobacco container.

4. The atomizer of claim 2, wherein the heating element is arranged in the inner chamber of the tobacco container.

5. The atomizer of claim 1, wherein an air hole is defined in a bottom portion or a lateral surface of the tobacco container; the hollow air path structure is connected to the air hole; and the heating element is arranged on an outer lateral surface of the tobacco container.

6. The atomizer of claim 1, wherein a connecting pipe is inserted on a bottom portion of the fixed housing; and the connecting pipe is configured for cooperating with an air path inlet of an external hookah.

7. The atomizer of claim 6, wherein a voice device electrically connected to the second micro control element is provided on the battery housing; and the voice device receives information delivered by the second micro control element and plays audio of predetermined content to indicate heating status of the atomizer.

* * * * *